US005701822A

United States Patent [19]

Métrope

[11] Patent Number: 5,701,822

[45] Date of Patent: Dec. 30, 1997

[54] DEVICE FOR CHANGING PRINTING FORMS OR PLATES

[75] Inventor: Jacques Métrope, Laigneville, France

[73] Assignees: Heidelberger Druckmaschinen AG, Heidelberg, Germany; Heidelberg Harris SA, Montataire Cedex, France

[21] Appl. No.: 627,772

[22] Filed: Apr. 1, 1996

[30] Foreign Application Priority Data

Mar. 31, 1995 [FR] France ..... 95 03828

[51] Int. Cl.[6] ..... B41F 27/06; B41F 21/00

[52] U.S. Cl. ..... 101/477; 101/415.1

[58] Field of Search ..... 101/477, 415.1

[56] References Cited

U.S. PATENT DOCUMENTS

| | | | |
|---|---|---|---|
| 5,218,907 | 6/1993 | Komori et al. | 101/415.1 |
| 5,289,775 | 3/1994 | Spiegel et al. . | |
| 5,293,820 | 3/1994 | Maejima et al. . | |
| 5,406,888 | 4/1995 | Sugiyama et al. | 101/415.1 |
| 5,440,988 | 8/1995 | Ito | 101/477 |
| 5,460,092 | 10/1995 | Beisel et al. | 101/477 |
| 5,479,858 | 1/1996 | Beisel et al. | 101/477 |
| 5,495,805 | 3/1996 | Beisel et al. | 101/477 |

FOREIGN PATENT DOCUMENTS

| | | |
|---|---|---|
| 0 520 594 | 12/1992 | European Pat. Off. . |
| 0 530 577 | 3/1993 | European Pat. Off. . |
| 0 567 754 | 11/1993 | European Pat. Off. . |
| 0 519 583 | 12/1993 | European Pat. Off. . |
| 94/06631 | 3/1994 | WIPO . |

*Primary Examiner*—Eugene H. Eickholt

*Attorney, Agent, or Firm*—Herbert L. Lerner; Laurence A. Greenberg

[57] ABSTRACT

Device for changing printing forms on cylinders of printing presses, including a swivelable printing-form loading unit having respective compartments for feeding and for removing printing forms, the loading unit being swivelable into an operating position at a gap formed in a printing-form cylinder equipped with clamping devices, and into a loading position wherein the loading unit is retracted from the operating position thereof, further includes a holding element having an insertion region for a printing form to be removed from the printing-form cylinder, and devices for transporting a printing form to be fed onto the printing-form cylinder, the printing-form loading unit being swivelable into a vertical loading position thereof at the holding element.

9 Claims, 8 Drawing Sheets

DEVICE FOR CHANGING PRINTING FORMS OR PLATES

BACKGROUND OF THE INVENTION

FIELD OF THE INVENTION

The invention relates to a device for changing printing forms or plates on cylinders of printing presses, having a swivelable printing-form or plate loading unit including equipment for feeding and equipment for removing forms or plates, the loading unit being swivelable into an operating position at a gap of a form or plate cylinder equipped with clamping devices and into a loading position wherein the loading unit is retracted from the operating position thereof.

From the state of the art exemplified in the published European Patent Document EP 0 519 583, a plate changing device for printing presses has become known heretofore. A bevel gear train or transmission arranged above a printing unit reciprocatingly displaces a plate-holding unit. A toothed rack provided at a rearward part of the plate-holding unit meshes with a gear mounted on a bevel-gear shaft for the purpose of achieving therewith a vertical displacement of the plate-holding unit.

The published European Patent Document EP 0 530 577 Al describes a device for positioning a magazine used for automatic changing of printing plates. A magazine positionable into a plurality of positions is harmoniously integrated into the printing press as a whole, in accordance with this conception. This magazine can assume a printing-plate changing position, a position for exchanging plates in the magazine, as well as a service position and a normal operating position. The magazine is displaceable in a vertical guide and is swivelable about a horizontal axis; furthermore, drives for effecting the displacement and a tilting or tipping of the magazine are also provided. With this arrangement, coverage of the delivery side of a printing unit of a sheet-fed printing press in the normal operating position of the magazine is achievable, so that the latter also functions as a safety or protective device.

The published European Patent Document EP 0 520 594 Al describes a device for changing printing forms in printing presses. A printing-form magazine is mounted so as to swivel between a working position and a printing-form loading position. Rotatable rollers are provided at an end of the magazine facing towards the printing unit and, during the changing of a printing form, i.e., when the magazine is positioned at or close to the fastening or lock-up device of the printing-form cylinder, the rollers brace the magazine against the plate cylinder in order to keep the magazine in position during the changing of the printing form.

SUMMARY OF THE INVENTION

It is accordingly an object of the invention to provide a device for changing printing forms which, based upon the aforementioned prior art, optimizes printing-form changing by facilitating accessibility to the components of the printing unit.

With the foregoing and other objects in view, there is provided, in accordance with the invention, a device for changing printing forms on cylinders of printing presses, including a swivelable printing-form loading unit having respective compartments for feeding and for removing printing forms, the loading unit being swivelable into an operating position at a gap formed in a printing-form cylinder equipped with clamping devices, and into a loading position wherein the loading unit is retracted from the operating position thereof, comprising a holding element having an insertion region for a printing form to be removed from the printing-form cylinder, and devices for transporting a printing form to be fed onto the printing-form cylinder, the printing-form loading unit being swivelable into a vertical loading position thereof at the holding element.

In accordance with another feature of the invention, the insertion region is operatively associated with the printing-form removing compartment of the printing-form loading unit.

In accordance with a further feature of the invention, the printing-form transporting devices are disposed on the holding element and engage in a transport plane for the respective printing form which is disposed in the printing-form feeding compartment and is to be fed onto the printing-form cylinder.

In accordance with an added feature of the invention, the printing-form changing device includes a protection device for supporting the printing-form loading unit in an operating position thereof.

In accordance with an additional feature of the invention, the printing-form changing device includes a roller positionable at the printing-form cylinder for facilitating the printing-form removal from and mounting on the printing-form cylinder.

In accordance with yet another feature of the invention, the positionable roller is a dampening-solution applicator roller of a printing unit.

In accordance with yet a further feature of the invention, the printing-form changing device includes stops for the printing forms, and respective control units operatively associated with the printing-form removing and feeding compartments of the printing-form loading unit for actuating the stops.

In accordance with yet an added feature of the invention, one of the stops comprises a prestressed lever.

In accordance with yet an additional feature of the invention, one of the stops is movable parallel to the longitudinal direction of the printing-form removing compartment.

In accordance with still another feature of the invention, the printing-form changing device includes a connecting link guide, one of the stops being displaceable in the connecting link guide.

In accordance with a concomitant feature of the invention, one of the stops is operatively associated with the printing-form feeding compartment for gripping a trailing edge of a printing form disposed therein and to be newly fed onto the printing-form cylinder.

An advantage derived from the device constructed in accordance with the invention is essentially that it is possible therewith to obviate or dispense with adjustment elements for accompanying the movements in the contact region between the printing form and the holding element when the old or used printing form is removed from and the new printing form is fed or mounted onto the form cylinder, because the intrinsic elasticity of the printing form is used both in the removal and in the mounting thereof. The swivelability of the printing-form loading unit or magazine permits free access to the printing unit and free access to the magazine or loading unit in the loading position thereof, for example, from a platform.

According to an advantageous embodiment of the invention, provision is made therein for associating the input or insertion region of the holding element with the printing-form removal compartment of the printing-form loading unit so that a continuous transport plane is formed. The transport devices are mounted on the holding element so that they extend into the transport plane of the printing-form removal compartment.

A protection or safety device can be used for supporting the printing-form loading unit when the protection device is in an inactive position thereof during the changing of printing forms, no separate or additional devices for supporting the loading unit or for positioning it at the printing-unit cylinder being required. A roller which is already present in the printing press, such as a dampening-solution applicator roller, for example, can be used for tightly pressing the printing form against and in matching engagement with the surface of the printing-form cylinder, no separate pressure mechanism being necessary.

The respective printing forms present in the printing-form loading unit are stopped or blocked and are released by means of stops which are activatable by a respective separate control or positioning unit. The stops which are provided in the exemplary embodiment are prestressed or pre-tensioned levers or hooks which can be displaceable in guides or accommodated in a stationary or fixed position in the printing-form loading unit.

Other features which are considered as characteristic for the invention are set forth in the appended claims.

Although the invention is illustrated and described herein as embodied in a device for changing printing forms, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

The invention will be described in more detail by way of nonlimiting example with reference to the attached drawings, in which:

DESCRIPTION OF THE PREFERRED EMBODIMENTS

Figure 1:
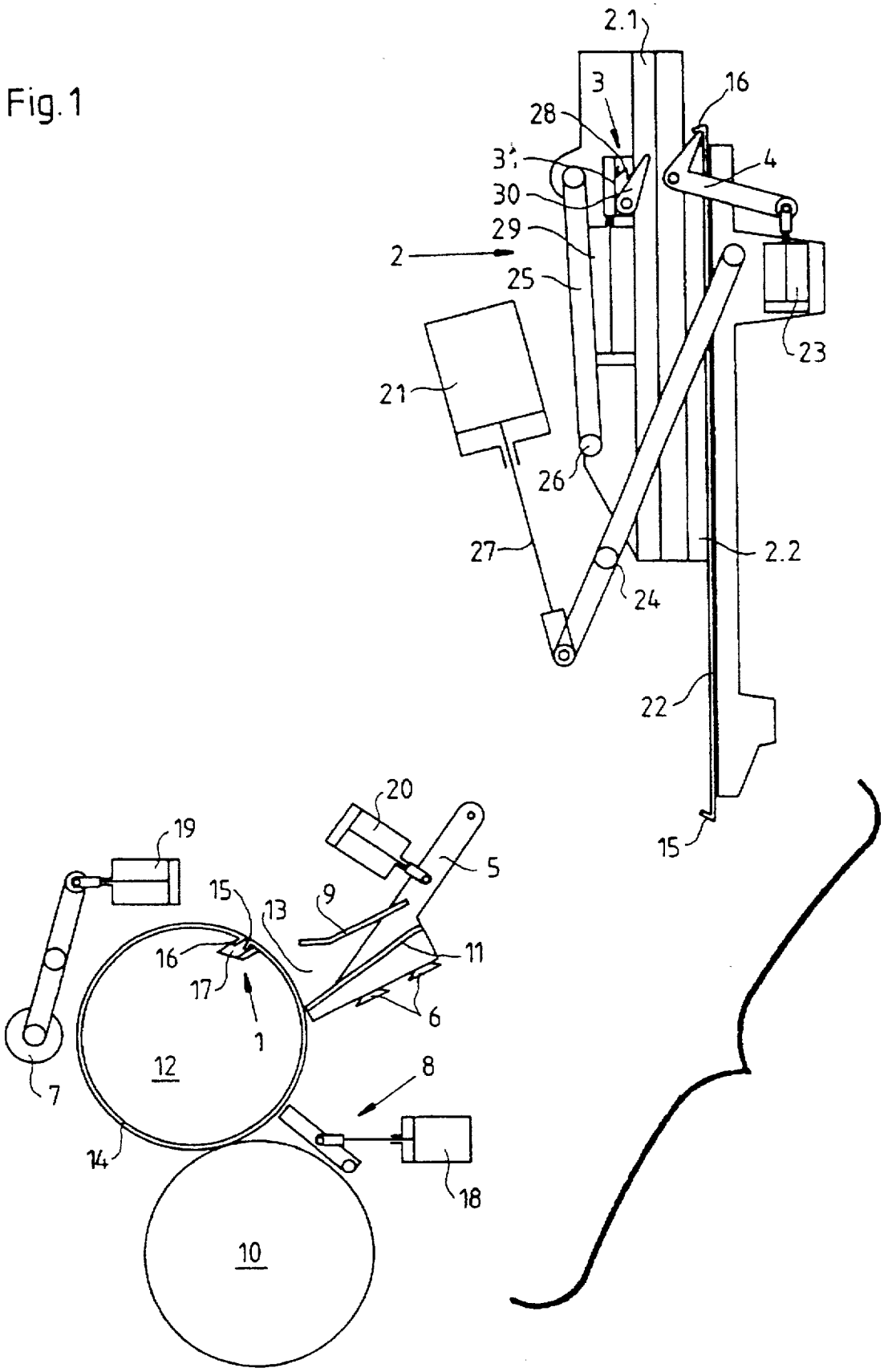
FIG. 1 is a diagrammatic side elevational view of a printing-form loading unit according to the invention, which is shown in a vertical position with a printing form to be fed onto a form cylinder, the printing form being oriented perpendicularly to the loading unit.

Referring now to the drawings and, first, particularly to FIG. 1 thereof, there is shown therein the swivelable printing-form loading unit in a vertical loading position.

The swivelable printing-form loading unit 2 is formed of a printing-form removal compartment 2.1 and a printing-form feeding compartment 2.2. A movable stop 3 provided in a rear part of-the printing-form removal compartment 2.1 ensures the insertion of a printing form 14, which is to be removed from a printing-form cylinder 12, fully into the printing-form removal compartment 2.1. A hook 4 holds a printing form 22 in a vertical position in the printing-form feeding compartment 2.2 prior to feeding it onto the printing-form cylinder 12 after the printing form 14 which is mounted thereon is removed therefrom in a manner described hereinafter. The printing form 22 is formed with respective bent leading and trailing edges 15 and 16, the trailing edge 16 being releasable by a control unit 23 which moves the hook 4. By means of a swivel unit 21, represented herein diagrammatically as a piston/cylinder unit, the printing-form loading unit 2 is swivelable about a swivel pin 24 and positioned at a stopping point 26 on a holder 25. The printing-form loading unit 2 includes, above the printing-form removal compartment 2.1, a control unit 29, by means of which a the stop 3 is displaceable, through the intermediary of a connecting link guide 31, parallel to the longitudinal direction of the printing-form removal compartment 2.1. The stop 3 includes a rotatably mounted lever 30, which is positioned resiliently by means of a prestressing element 28 and which grips the trailing edge 16 of a printing form 14 which has been removed and is running into the printing-form removal compartment 2.1.

A protection device 8, which also serves as a support for the printing-form loading unit 2, after the latter has been swung into the operating position thereof, as well as a holding element 5, is provided in proximity to the printing unit which is made up of a transfer cylinder 10 and a form cylinder 12. The support element 5, as well as the protection device 8, are both swivelable by respective control or positioning units 18 and 20, it being immaterial whether the control or positioning units 18 and 20, respectively, are in the form of pneumatic cylinders, electric motors or the like. This applies as well to a control or positioning unit 19 by which a roller 7 is positionable at or engageable with the surface of the printing-form cylinder 12 and again disengageable or separable therefrom. The leading edge 15 and the trailing edge 16 of a printing form 14 which is to be removed from the printing-form cylinder 12, are positioned at the moment on the outer surface of the printing-form cylinder 12 but, however, clamped in a gap or channel 17 formed in this printing-form cylinder 12. An automatic clamping device 1 is provided in the gap or channel 17 for clamping the printing forms 14 and 22, respectively. The hereinaforementioned swivelable holding element 5 is formed with an upper guide surface 9 and a lower guide surface 11 which define a funnel-shaped input region 13 therebetween. Transport devices 6 formed as suckers or suction cups are located on the underside of the holding element 5, and aid in positioning, at the outer surface of the printing-form cylinder 12, a printing form 22 which is to be applied thereon.

Figure 2:
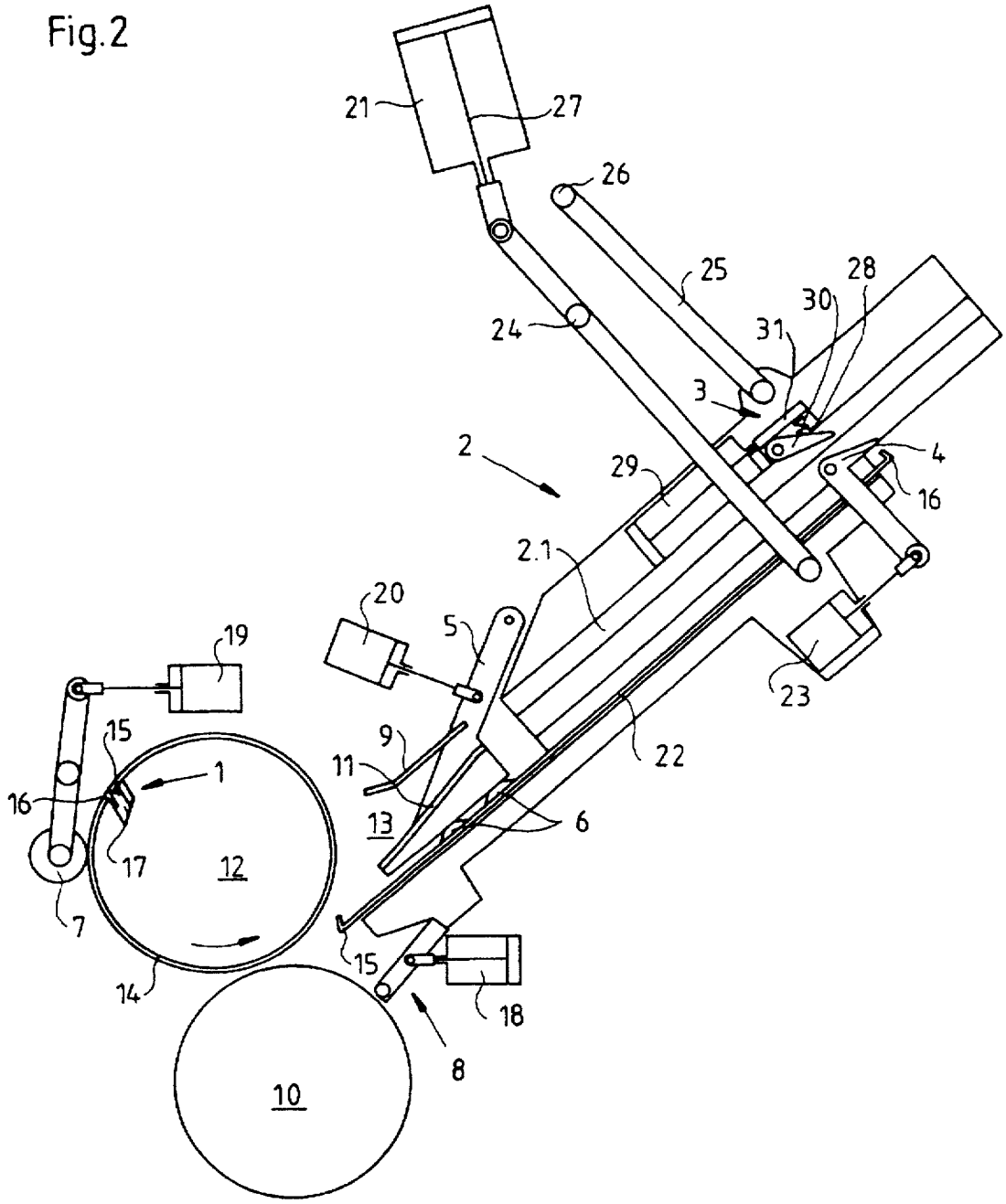
FIG. 2 is a view like that of FIG. 1 of the printing-form loading unit in an operating phase thereof wherein it is positioned at a holding element.

FIG. 2 represents the printing-form loading unit 2 in a condition wherein it is positioned at the holding element 5.

Before this printing-form loading unit 2 is positioned at the holding element 5, the control or positioning unit 18 swivels the protection device 8 so that it serves as a support for the front part of the printing-form loading unit 2. The transport devices 6 grip the rear surface of the new printing form 22 which is to be applied to the surface of the form cylinder 12; via the control or positioning unit 23, the hook 4 is then actuated so as to release the trailing edge 16 of the printing form 22 inside the printing-form feeding compartment 2.2. The control or positioning unit 19 then positions the roller 7 to bear against the surface of the printing form 14 mounted on the plate cylinder 12. This roller 7 may be a previously existing standard roller, for example a dampening-solution applicator roller or the like; in any case, a separate pressure roller is not required.

Figure 3:
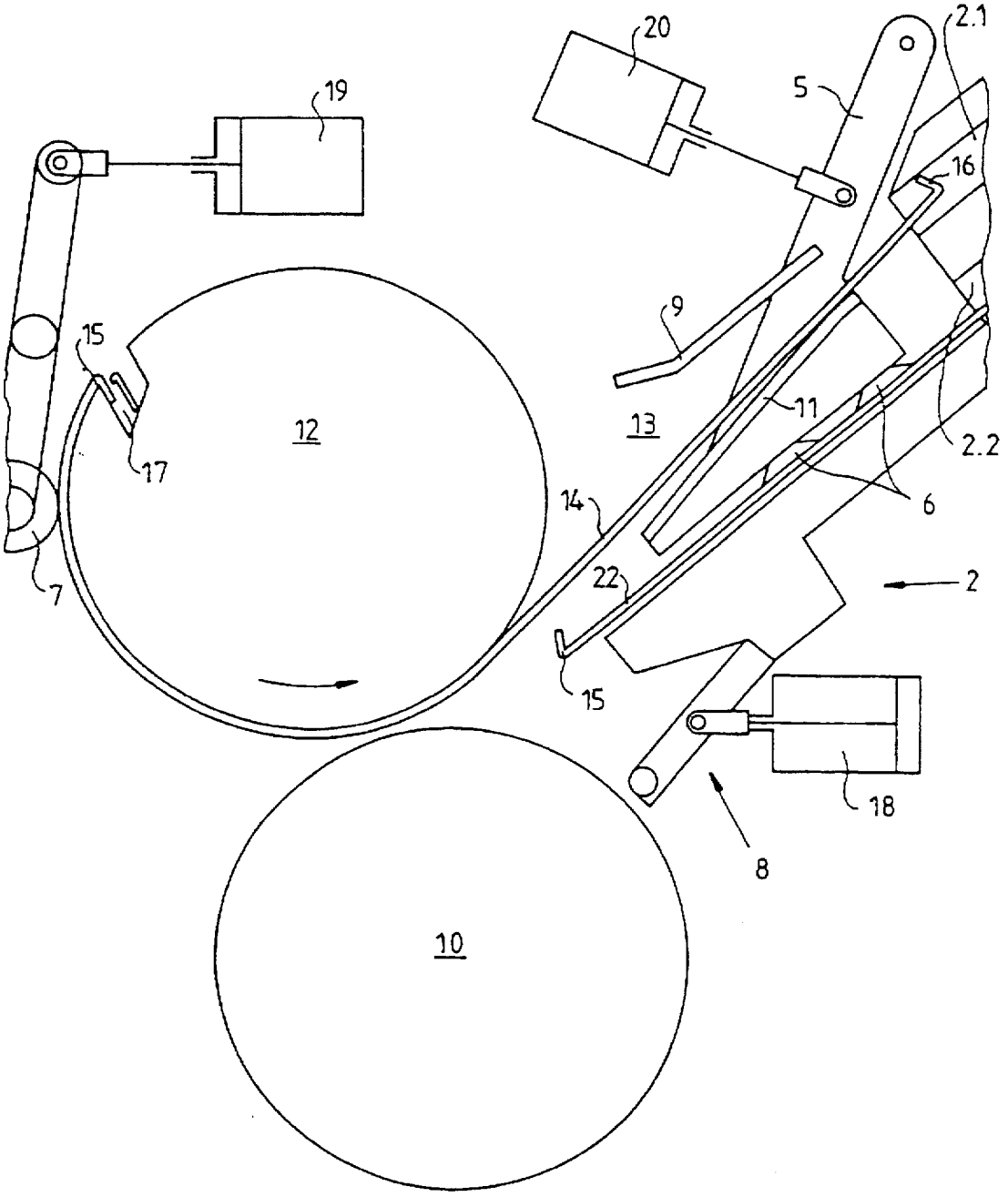
FIG. 3 is an enlarged fragmentary view of FIG. 2 showing the printing-form changing device in another operating phase thereof wherein a rearward or trailing end of a printing form to be taken up by the form cylinder is being inserted into a printing-form removal unit.

The printing-form cylinders 12 rotate slowly in reverse until the gap or channel 17 is positioned opposite the lower guide surface 11 of the holding element 5. The automatic clamping device 1 then releases the trailing edge 16 of the printing form 14 before immediately reclosing in order to continue to clamp the leading edge 15. The trailing edge 16 runs into the insertion region 13 through which, in accordance with FIG. 3, it enters the printing-form removal compartment 2.1 of the printing-form loading unit 2 disposed at the holding element 5.

At this instant, the leading part of the printing form 22 which is to be fitted onto the form cylinder 12 is gripped by the transport devices 6 located under the holding element 5, and the new printing form 22 is thereby fixed in the printing-form feeding compartment 2.2. The insertion of the printing form 14 into the printing-form removal compartment 2.1 of the printing-form loading unit 2 is aided by the roller 7 positioned so as to bear against the surface of the printing form which is to be removed.

Figure 4:
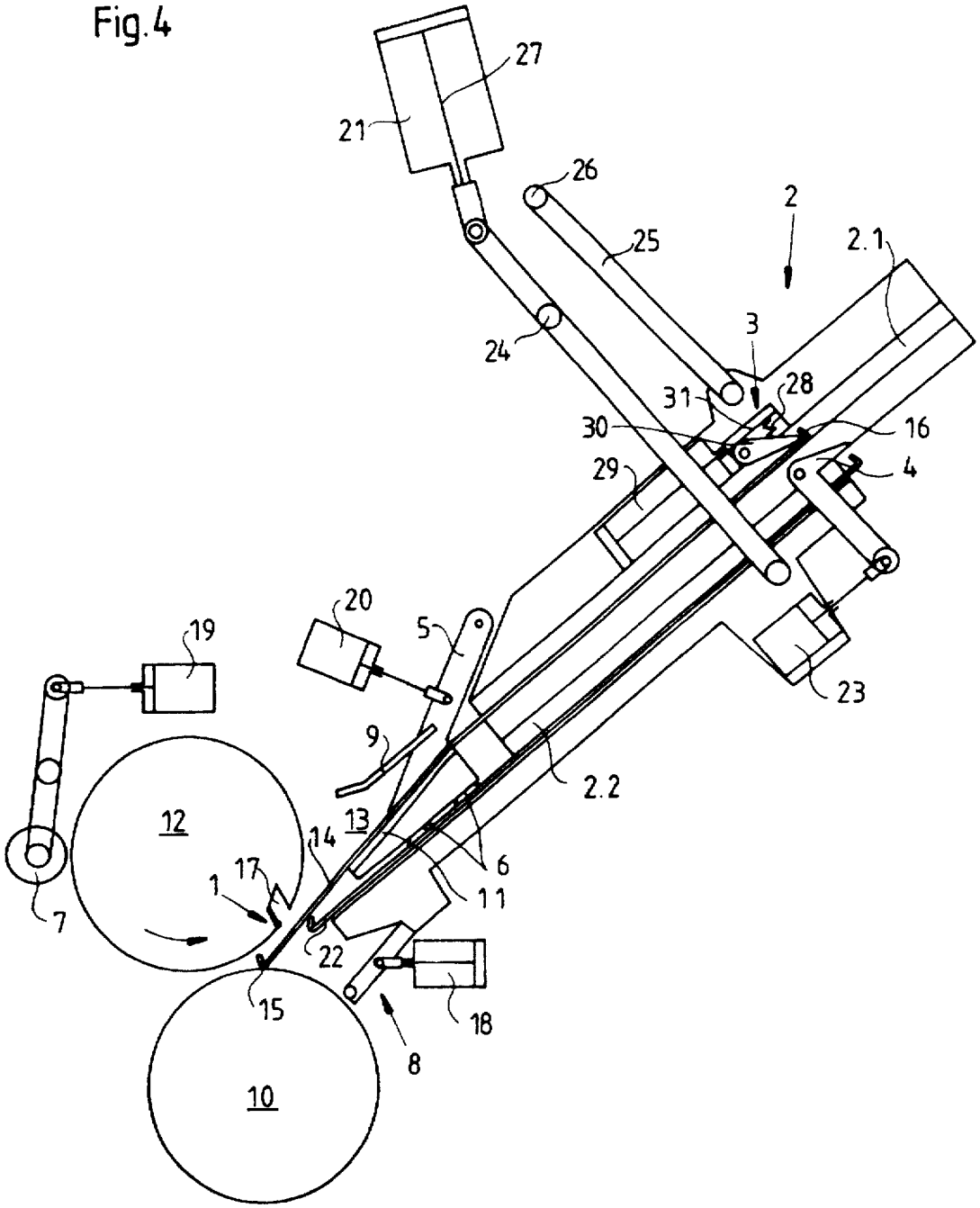
FIG. 4 is a view like that of FIG. 2 showing the printing-form changing device in another operating phase thereof wherein the removed printing form is inserted into the printing-form removal unit.

FIG. 4 shows how, after the release of the leading edge 15, the printing form 14 to be removed, which is resting on the lower guide surface 11 of the holding element 5, is gripped at the trailing edge 16 thereof by the prestressed lever 30 and is drawn into the printing-form removal compartment 2.1. The new printing form 22 to be fitted on the form cylinder 12 remains gripped in position by the transport device 6 located under the holding element 5, although the trailing edge 16 thereof has already been released from the hook 4.

Figure 5:
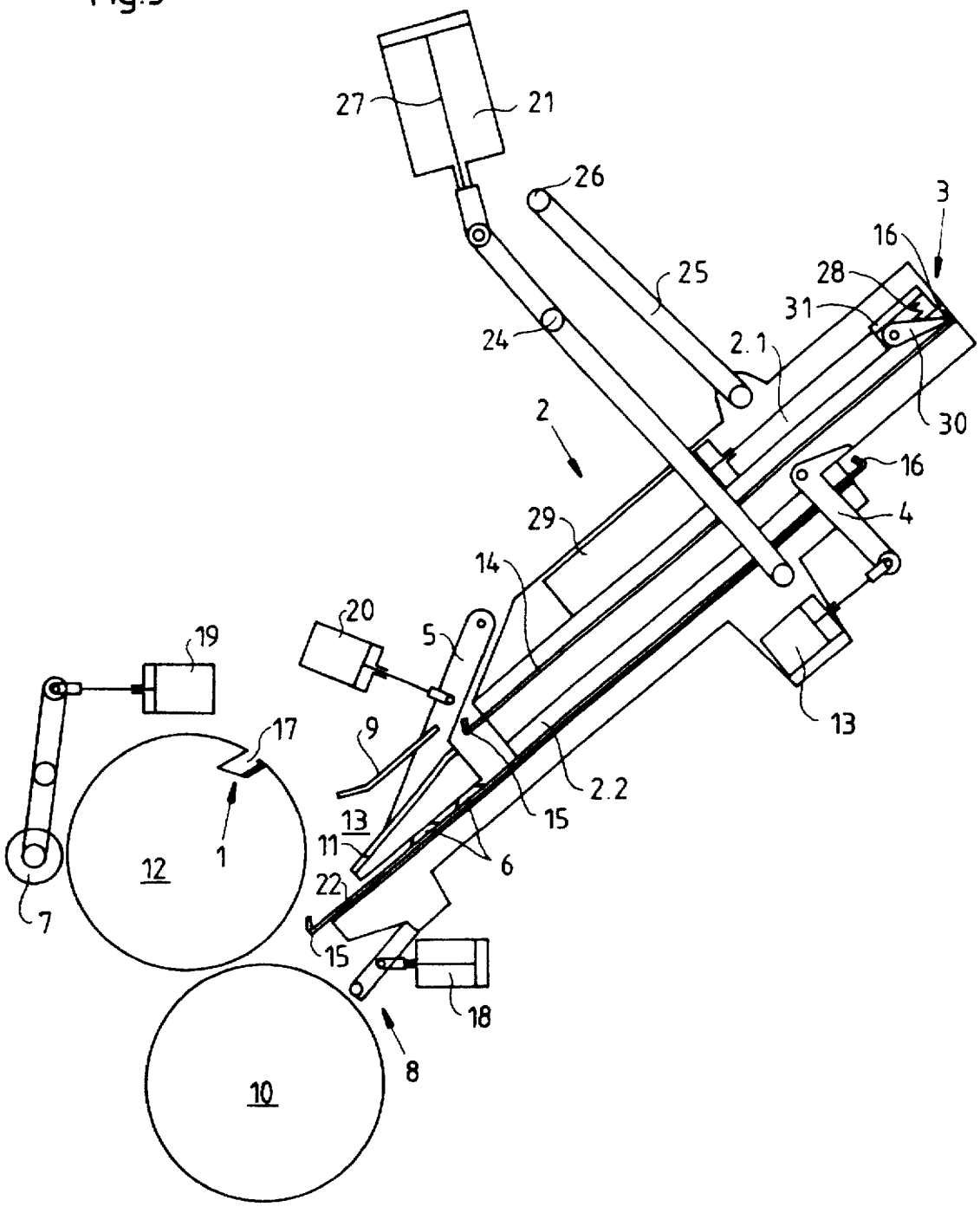
FIG. 5 is a view like that of FIG. 4 showing the printing-form changing device in a further operating phase thereof wherein the removed printing form is shown in a final position thereof in the printing-form removal unit.
Figure 6:
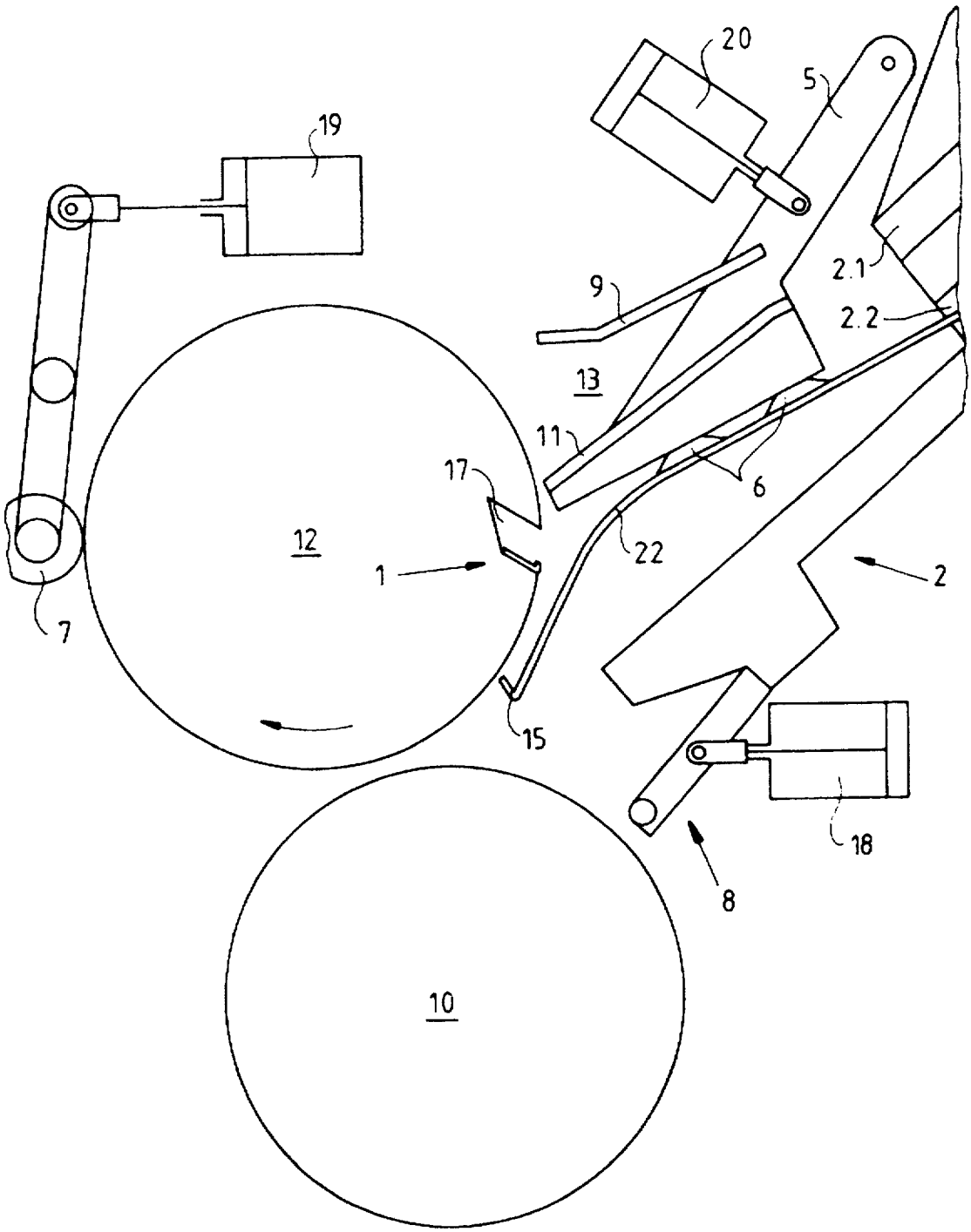
FIG. 6 is an enlarged fragmentary view of FIG. 5 representing a front or leading part of a printing form to be fed onto the form cylinder being positioned at the surface of the form cylinder.

It is apparent from the representation in FIG. 5 that the printing form 14 which is to be removed from the printing-form cylinder 12 is transported by a control or positioning unit 29 until it reaches the end, i.e., is fully inside, of the printing-form removal compartment 2.1. The control or positioning unit 29 is equipped with a connecting link guide 31 which accommodates the stop 3 together with the lever 30 which has been prestressed or pre-tensioned. The printing form 14 is thus drawn out of the insertion region 13 of the holding element 5 by means of which then the leading part of the previously gripped printing form 22 to be newly fitted on the form cylinder 12 is positioned to bear against the surface of the plate cylinder 12 in accordance with FIG. 6.

The leading edge 15 of the printing form 22 to be newly mounted, which is positioned at the outer cylindrical surface of the printing-form cylinder 12, remains held by the transport devices 6; after the leading edge 15 has penetrated into the gap or channel 17, the leading edge 15 is clamped by the automatic fastening device 1, and the printing form 22 can then be tautly mounted on and around the circumference of the cylinder 12, because the trailing edge 16 has been released from the hook 4.

Figure 7:
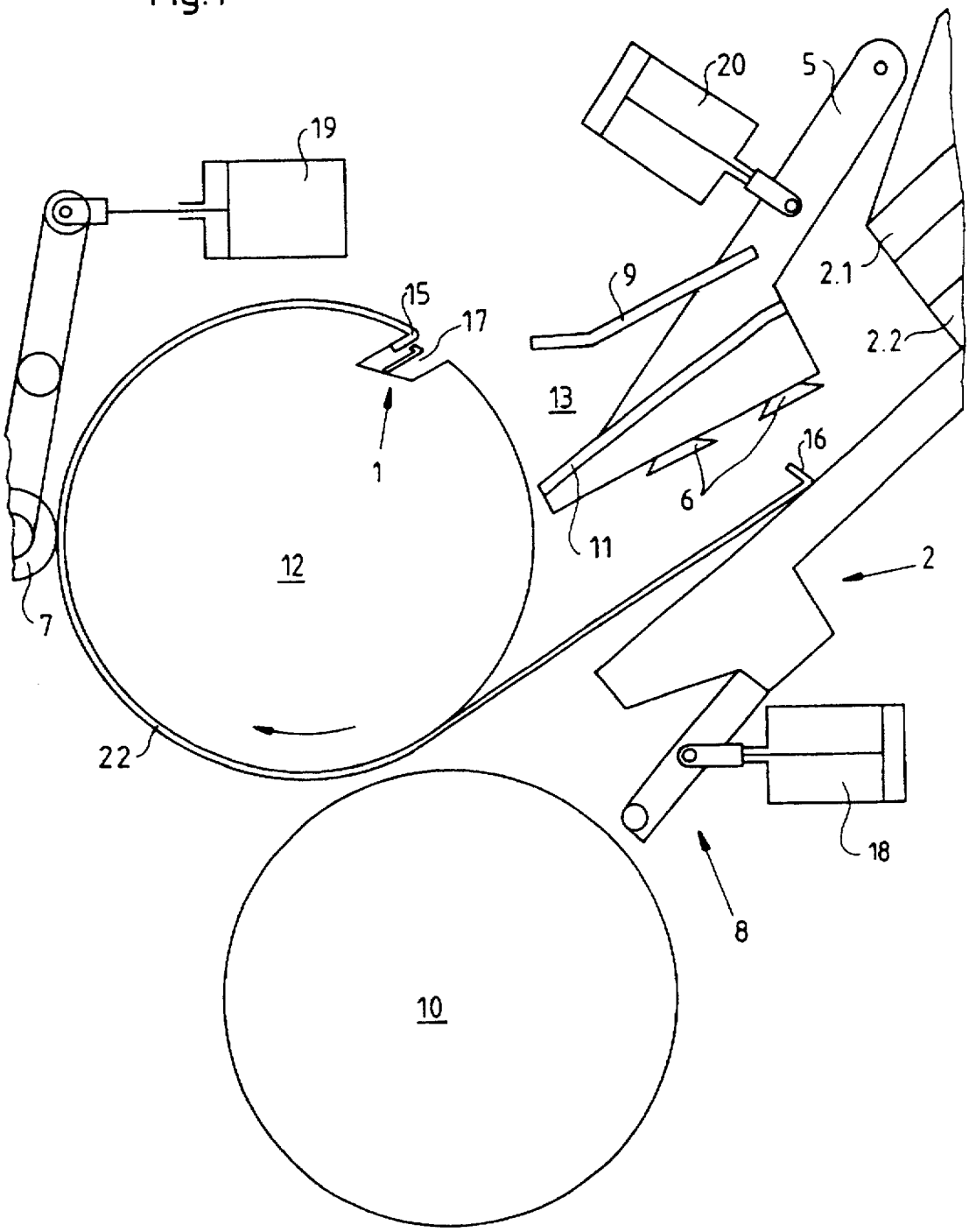
FIG. 7 is a view like that of FIG. 6 representing an end of the printing form which is to be newly mounted on the form cylinder after the end has been released from the holding element.

In accordance with FIG. 7, a roller 7 which is to be placed against the printing form 22 considerably facilitates the tight or tensioned mounting of the printing form 22, and presses the latter into conformity with the curvature of the surface of the plate cylinder 12. When the trailing edge 16 of the printing form 22 which is to be newly mounted on the printing-form cylinder 12 approaches the transport devices 6 located under the holding element 5, the transport devices 6 release this printing form 22 completely, so that it comes into contact with the circumference of the printing-form cylinder 12 with assistance provided by the roller 7. Because the inner sides of the printing-form feeding and removal compartments 2.2 and 2.1, respectively, are provided with a friction-reducing lining which protects the upper side of the printing forms, damage to the latter is prevented.

Figure 8:
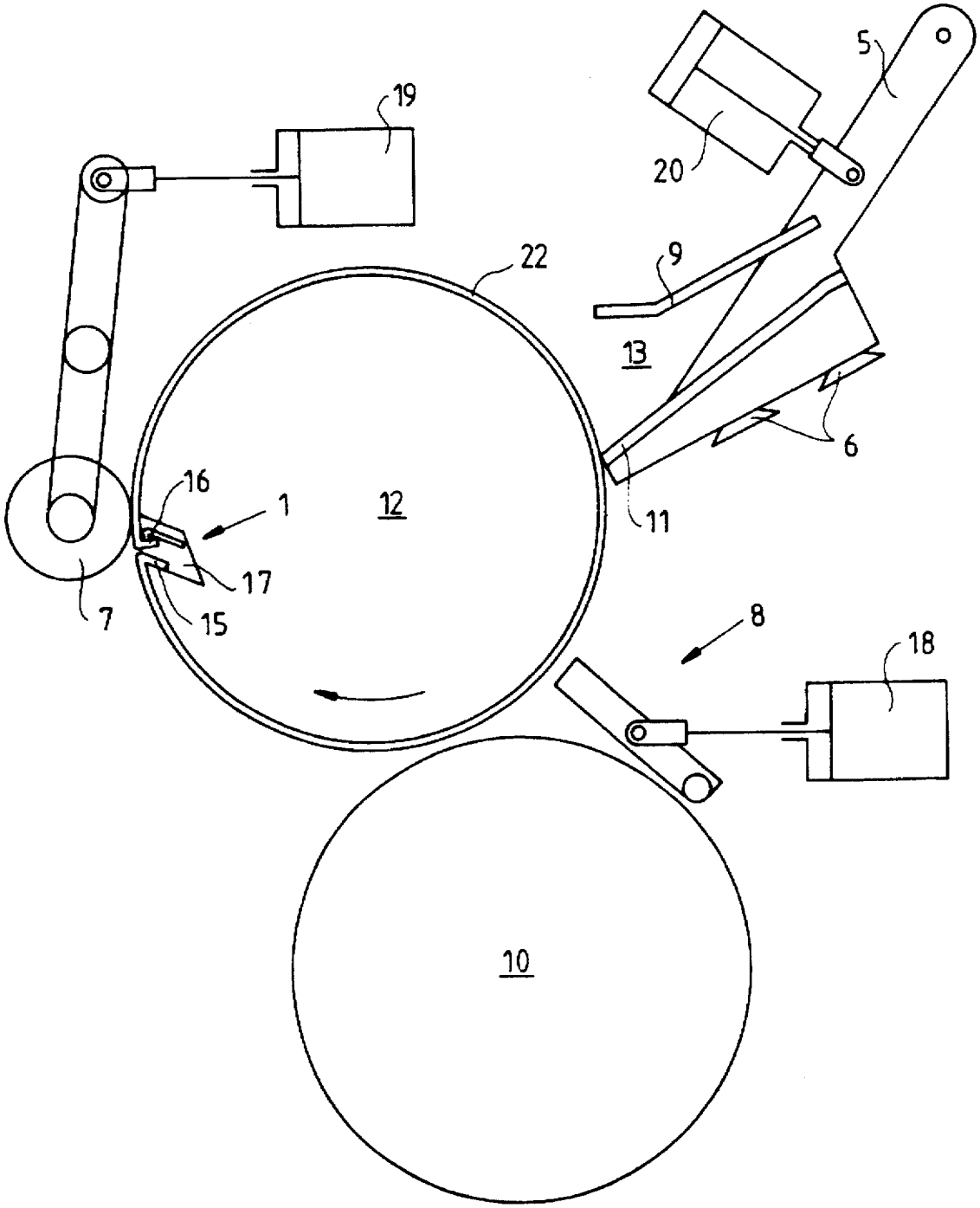
FIG. 8 is a view like that of FIGS. 6 and 7 showing the printing form, which has been applied to the form cylinder, being flattened or stroked smooth at the gap or channel formed in the form cylinder and extending in the axial direction thereof.

FIG. 8 shows how both the leading edge 15 and the trailing edge 16 of the printing form 22 have pressure applied thereto so that a minimum gap or space remains therebetween. The control or positioning unit 18 swivels the protection device 8 back into the space nip between the printing-unit cylinders 10 and 12 while, by means of the control or positioning unit 20, the holding element 5 is brought into a position spaced away from the circumference of the printing-form cylinder 12, and the swivelable printing-form loading unit 2 can then swing back into the loading position thereof.

I claim:

1. Device for changing printing forms on cylinders of printing presses, including a swivelable printing-form loading unit having respective compartments for feeding and for removing printing forms, the loading unit being swivelable into an operating position at a gap formed in a printing-form cylinder equipped with clamping devices, and into a loading position wherein the loading unit is retracted from the operating position thereof, comprising:

a holding element having an insertion region for a printing form to be removed from the printing-form cylinder, and said holding element having devices for transporting a printing form to be fed onto the printing-form cylinder, the printing-form loading unit being swivelable into a vertical loading position thereof at said holding element;

a plurality of stops for the printing forms and one of said stops having a prestressed lever; and control units operatively associated with the printing-form removing and feeding compartments of the printing-form loading unit for actuating said stops.

2. Printing-form changing device according to claim 1, wherein said insertion region is operatively associated with the printing-form removing compartment of the printing-form loading unit.

3. Printing-form changing device according to claim 1, wherein said printing-form transporting devices are disposed on said holding element and engage in a transport plane for the respective printing form which is disposed in the printing-form feeding compartment and is to be fed onto the printing-form cylinder.

4. Printing-form changing device according to claim 1, including a protection device for supporting the printing-form loading unit in an operating position thereof.

5. Printing-form changing device according to claim 1, including a roller positionable at the printing-form cylinder for facilitating the printing-form removal from and mounting on the printing-form cylinder.

6. Printing-form changing device according to claim 5, wherein said positionable roller is a dampening-solution applicator roller of a printing unit.

7. Printing-form changing device according to claim 1, wherein one of said stops is movable parallel to the longitudinal direction of the printing-form removing compartment.

8. Printing-form changing device according to claim 7, including a connecting link guide, one of said stops being displaceable in said connecting link guide.

9. Printing-form changing device according to claim 1, wherein one of said stops is operatively associated with the printing-form feeding compartment for gripping a trailing edge of a printing form disposed therein and to be newly fed onto the printing-form cylinder.

* * * * *